US009831579B1

(12) United States Patent
Gomelsky et al.

(10) Patent No.: US 9,831,579 B1
(45) Date of Patent: Nov. 28, 2017

(54) ADAPTER FRAME WITH A SET OF ELECTRICAL PADS ON ITS TOP AND BOTTOM SURFACES FOR A BOARD-TO-BOARD CONNECTION

(71) Applicant: MOTOROLA SOLUTIONS, INC., Schaumburg (IL)

(72) Inventors: Alexander Gomelsky, Holon (IL); Michael Astanovsky, Hadera (IL); Avihu Cohen, Pardes Hana-Karkur (IL); Guy Shimon, Tel-Aviv (IL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 15/225,155

(22) Filed: Aug. 1, 2016

(51) Int. Cl.

| | |
|---|---|
| ***H01R 12/00*** | (2006.01) |
| ***H01R 12/71*** | (2011.01) |
| ***H01R 13/6581*** | (2011.01) |
| ***H01R 13/719*** | (2011.01) |
| ***H01R 43/26*** | (2006.01) |

(52) U.S. Cl.
CPC ..... *H01R 12/716* (2013.01); *H01R 13/6581* (2013.01); *H01R 13/719* (2013.01); *H01R 43/26* (2013.01)

(58) Field of Classification Search
CPC ..... H01R 9/096; H01R 12/52; H01R 12/62; H01R 12/716; H01R 13/648; H01R 13/6581; H01R 13/719
USPC ..... 439/65, 69, 74, 607.01
See application file for complete search history.

(56) References Cited

U.S. PATENT DOCUMENTS

| | | | | |
|---|---|---|---|---|
| 5,199,884 | A * | 4/1993 | Kaufman | H01R 12/716 439/566 |
| 6,793,506 | B1 * | 9/2004 | Hirata | H01R 12/716 439/65 |
| 6,811,411 | B1 * | 11/2004 | Hirata | H01R 12/716 439/660 |
| 7,101,196 | B1 * | 9/2006 | McClelland | H01R 12/716 439/521 |
| 7,247,032 | B2 * | 7/2007 | Merz | H01R 13/6658 439/607.01 |
| 7,585,185 | B2 * | 9/2009 | Obikane | H01R 13/65802 439/108 |
| 8,292,630 | B1 * | 10/2012 | Bobuk | H01R 12/73 439/136 |
| 8,337,232 | B2 * | 12/2012 | Chang | H01R 13/6594 439/342 |

(Continued)

*Primary Examiner* — Chandrika Prasad
(74) *Attorney, Agent, or Firm* — Michael Best & Friedrich LLP

(57) ABSTRACT

A method and apparatus for board-to-board circuit connection. In one example, a connector system includes a printed circuit board having a first set of electrical pads and at least one electrical component positioned between the first set of electrical pads and an adapter frame. The adapter frame includes a second set of electrical pads on a bottom surface and connected to the first set of electrical pads of the printed circuit board and a third set of electrical pads on a top surface and electrically connected to the second set of electrical pads. The adapter frame further includes a chamber configured to house the at least one electrical component and having electrical shielding that forms at least a partial Faraday cage around the at least one electrical component. A connector receptacle having a set of pins is connected to the third set of electrical pads.

14 Claims, 6 Drawing Sheets

(56) References Cited

U.S. PATENT DOCUMENTS

| | | | | |
|---|---|---|---|---|
| 8,482,928 | B2 | 7/2013 | Capeleto et al. | |
| 9,287,235 | B2 | 3/2016 | Sweere | |
| 2003/0013325 | A1* | 1/2003 | Zaderej | H01R 23/688 439/74 |
| 2003/0124879 | A1* | 7/2003 | Ng | H01R 12/714 439/66 |
| 2004/0156583 | A1 | 8/2004 | Totani et al. | |
| 2006/0089018 | A1* | 4/2006 | Orita | H01R 12/57 439/74 |
| 2012/0045908 | A1* | 2/2012 | Chang | H01R 13/6594 439/55 |

* cited by examiner

ADAPTER FRAME WITH A SET OF ELECTRICAL PADS ON ITS TOP AND BOTTOM SURFACES FOR A BOARD-TO-BOARD CONNECTION

BACKGROUND OF THE INVENTION

Electronic devices such as portable communications devices often include many electrical components within a small area. Electronic devices may also include multiple printed circuit boards. In these conditions, meeting electromagnetic compatibility (EMC) requirements and avoiding desense can be challenging.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
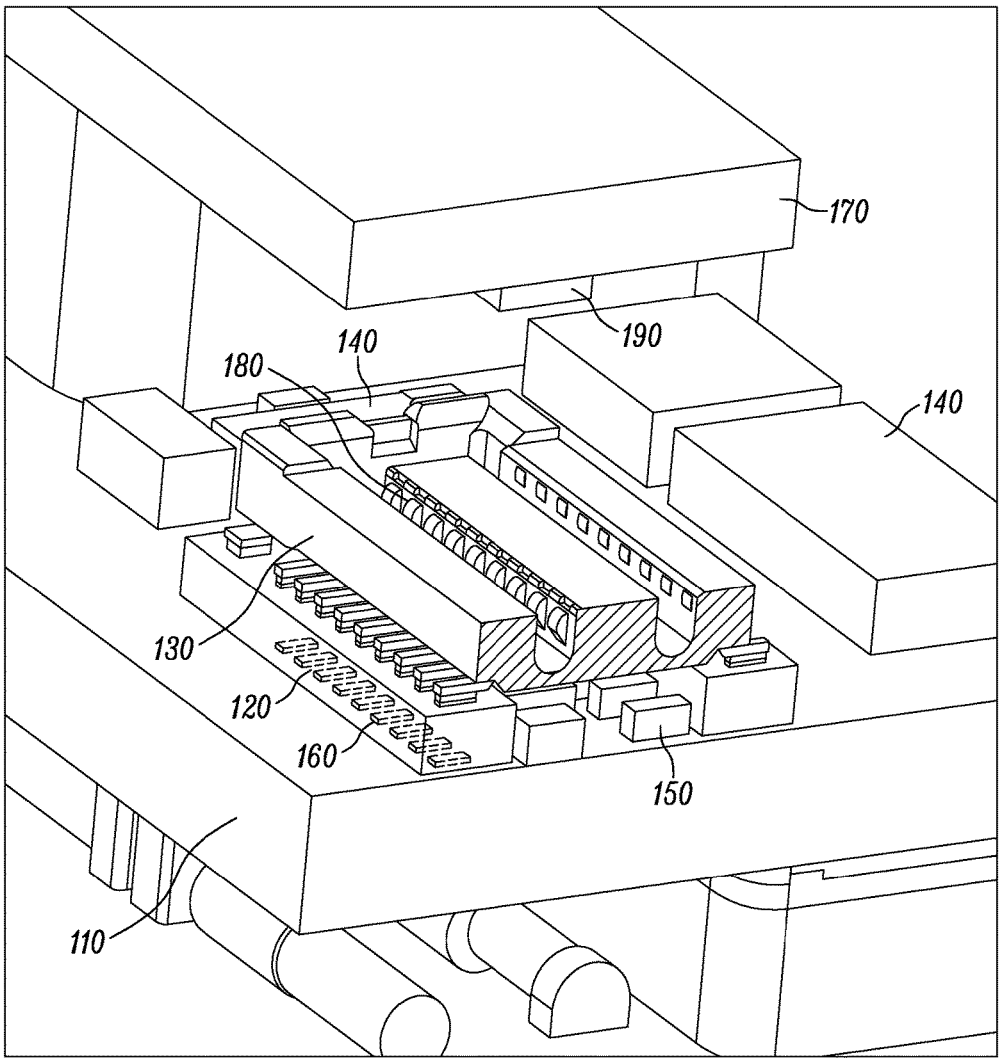
FIG. 1 is a perspective view of a connector system in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Multiple printed circuit boards are often connected to each other with board-to-board connectors. Board-to-board connectors include connector pins that are connected to electrical pads on the printed circuit boards. To help meet electromagnetic compatibility requirements, it is often necessary to place filtering components in close proximity to the connector pins and electrical pads. However, this is not always possible with current circuit board and connector technology.

One embodiment provides a connector system including a printed circuit board having a first set of electrical pads and at least one electrical component positioned between the first set of electrical pads. The connector system also includes an adapter frame having a bottom surface and a top surface. The adapter frame includes a second set of electrical pads on the bottom surface and connected to the first set of electrical pads of the printed circuit board. The adapter frame also includes a third set of electrical pads on the top surface and electrically connected to the second set of electrical pads. The adapter frame further includes a chamber configured to house the at least one electrical component and having electrical shielding that forms at least a partial Faraday cage around the at least one electrical component. The connector system further includes a connector receptacle having a set of pins connected to the third set of electrical pads.

Another embodiment provides a method of connecting a first printed circuit board and a second printed circuit board including positioning at least one electrical component between a first set of electrical pads on the first printed circuit board. The method also includes connecting the first set of electrical pads to a second set of electrical pads positioned on a bottom surface of an adapter frame and forming at least a partial Faraday cage around the at least one electrical component via a chamber of the adapter frame that includes electrical shielding. The method further includes connecting a third set of electrical pads positioned on a top surface of the adapter frame to a set of pins of a connector receptacle and connecting the connector receptacle to a connector plug mounted to the second printed circuit board.

Yet another embodiment provides a portable communication device including a printed circuit board having a first set of electrical pads and at least one electrical component positioned between the first set of electrical pads and a communication module including an adapter frame. The adapter frame has a bottom surface and a top surface. The adapter frame includes a second set of electrical pads on the bottom surface and connected to the first set of electrical pads of the printed circuit board. The adapter frame also includes a third set of electrical pads on the top surface and electrically connected to the second set of electrical pads. The adapter frame further includes a chamber configured to house the at least one electrical component and having electrical shielding that forms at least a partial Faraday cage around the at least one electrical component. The communication module also includes a connector receptacle having a set of pins connected to the third set of electrical pads.

FIG. 1 is a perspective view of an example connector system 100. In the example illustrated, the connector system 100 includes a printed circuit board 110, an adapter frame 120, a board-to-board connector 130, and board components 140 (for example, including electrical components 150). The connector system 100 may be located within an electronic device such as a mobile communications device, a tablet computer, a laptop computer, or the like. The connector system 100 may be used to connect the printed circuit board 110 with a second printed circuit board 170. In some embodiments, the printed circuit board 110 is the main circuit board and includes a central processing unit of the electronic device. In other embodiments, the printed circuit board 110 is a supplementary circuit board such as a camera circuit board or a graphics circuit board including components of the camera unit or the graphics unit respectively.

The adapter frame 120 is, for example, a frame-shaped spacer-adapter with internal space that is positioned over a first set of electrical pads 160 of the printed circuit board 110. As shown in FIG. 1, the internal space of the adapter frame 120 is a rectangular shaped through-hole formed by the inner boundaries of the adapter frame 120. In some embodiments, as described below, the internal space formed by the through-hole may be of a different shape such as square-shape, oval-shape, circle-shape, or the like. In other embodiments, instead of a through hole, the internal space may be a chamber of any shape formed by the internal boundaries and a top surface of the adapter frame 120. In one embodiment, the board-to-board connector 130 is a commercially-available board-to-board connector such as, for example, a SlimStack™ connector sold by Molex, LLC. The board-to-board connector 130 may include a connector receptacle 180 and a connector plug 190. In some embodiments, the connector receptacle 180 is soldered to the adapter frame 120 whereas the connector plug 190 is soldered to the second printed circuit board 170. The connector receptacle 180 receives the connector plug 190 to electrically connect the printed circuit board 110 and the second printed circuit board 170. The board components 140 (for example, including electrical components 150) are the components fixed to the printed circuit board 110. The board components 140 for example, including electrical components 150) are, for example, filtering components, capacitors, digital-to-analog converters, analog-to-digital converters, and the like. In some embodiments, the connector system 100 is part of a communications module of a portable communications device. FIG. 1 illustrates only one example embodiment of a connector system 100. In other embodiments, the connector system 100 may include more of fewer components and may perform functions that are not explicitly described herein.

Figure 2A:
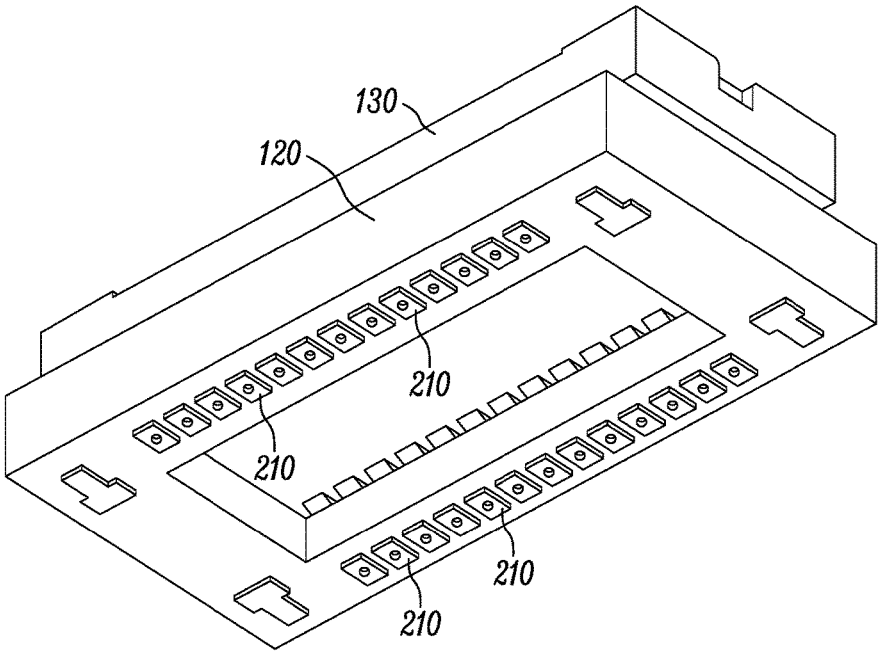
FIGS. 2A and 2B are perspective views of an adapter frame including a board-to-board connector in accordance with some embodiments.
Figure 2B:
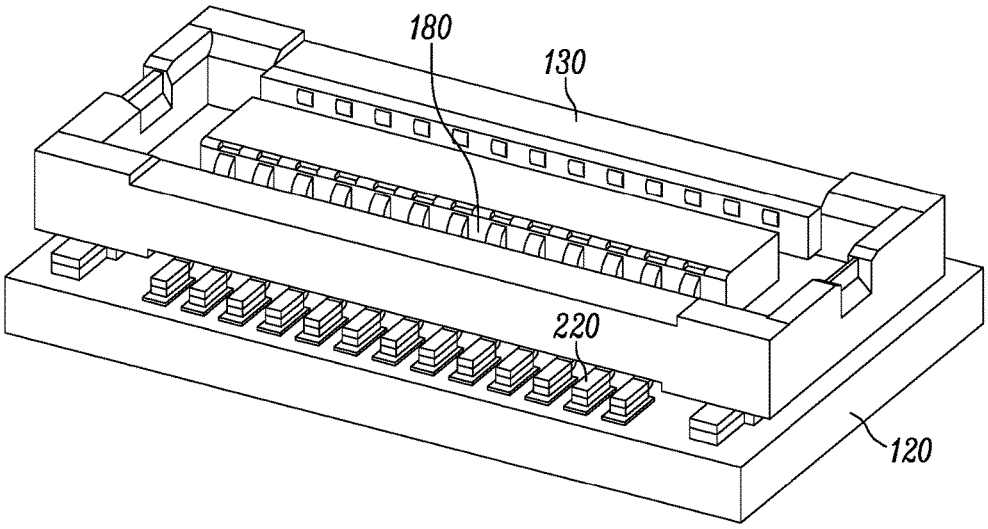

FIGS. 2A and 2B are perspective views of the adapter frame 120 connected to the board-to-board connector 130. FIG. 2A illustrates a bottom surface of the adapter frame 120. The bottom surface of the adapter frame 120 includes a second set of electrical pads 210. The second set of electrical pads 210 are coupled to the first set of electrical pads 160 of the printed circuit board 110. As shown in FIG. 2B, the top surface of the adapter frame 120 is coupled to the board-to-board connector 130.

Figure 3:
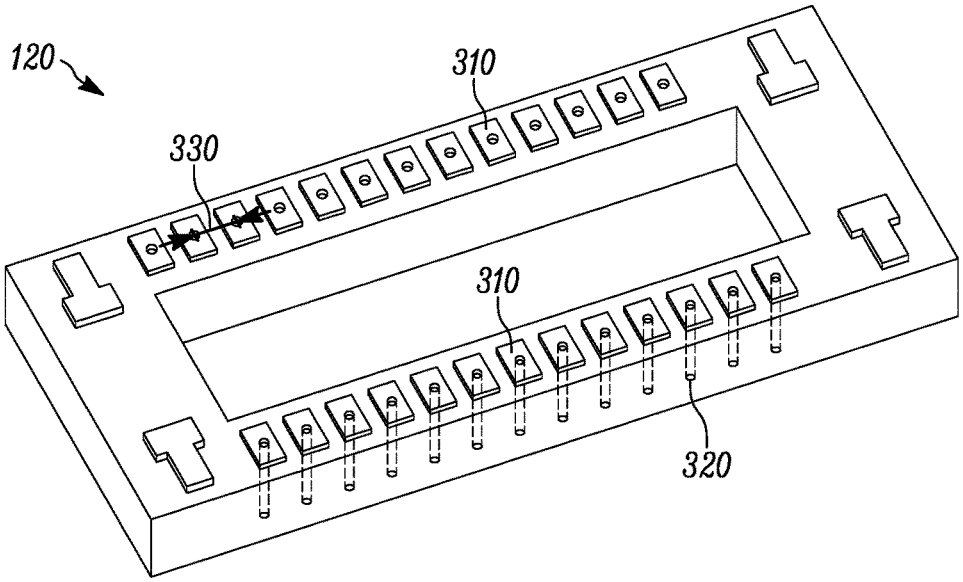
FIG. 3 is a perspective view of an adapter frame in accordance with some embodiments

FIG. 3 is a perspective view of the top surface of the adapter frame 120. The top surface of the adapter frame 120 includes a third set of electrical pads 310. The third set of electrical pads 310 are coupled to the set of connector pins 220 (as shown in FIG. 2B) of a connector receptacle 180 of the board-to-board connector 130. In some embodiments, the adapter frame 120 is a frame-shaped printed circuit board including the second set of electrical pads 210 and the third set of electrical pads 310 printed on the adapter frame 120. In these embodiments, the adapter frame 120 may be made of the same material as the printed circuit board 110. In some embodiments, the adapter frame 120 is rectangularly-shaped and includes the second set of electrical pads 210 and the third set of electrical pads 310. In other embodiments, the adapter frame 120 may be differently shaped, for example, square-shaped, circle shaped, oval shaped, or the like. In some embodiments, the adapter frame 120 is made from a material that is different (a "different material") from the materials of the printed circuit board 110. For example, the adapter frame 120 may be made from liquid-crystal polymers (LCP) or injection-molded thermoplastic.

Figure 4:
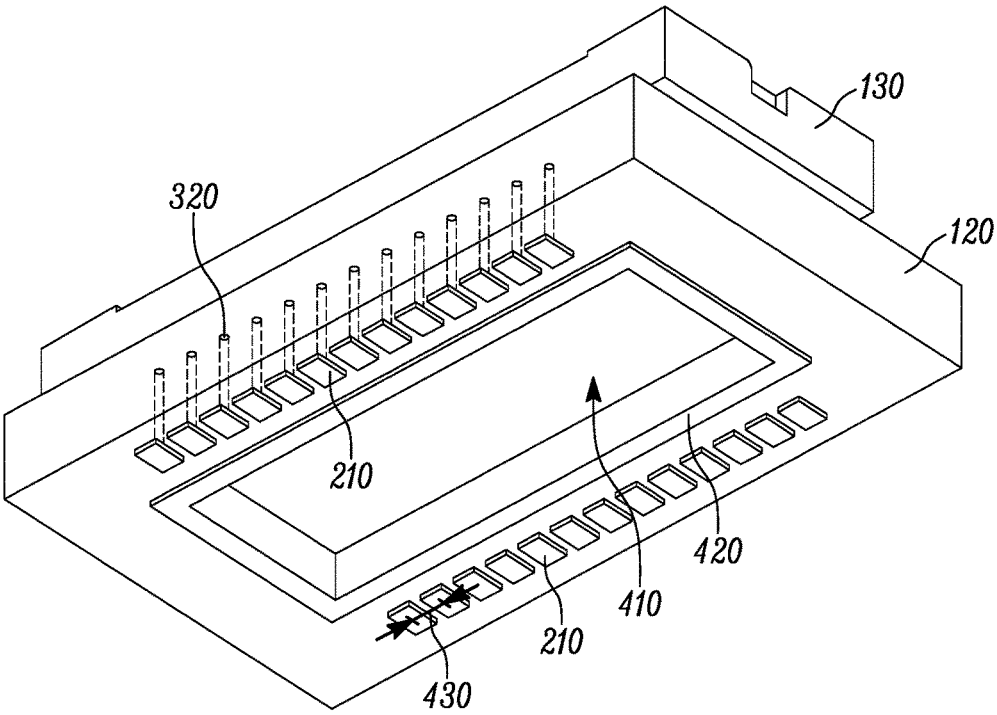
FIG. 4 is a perspective view of an adapter frame in accordance with some embodiments.

FIG. 4 is a perspective view of the bottom surface of the adapter frame 120. In the example illustrated, the bottom surface of the adapter frame 120 includes a chamber 410. The chamber 410 is formed under an electrical shielding 420. The electrical shielding 420 is built into the adapter frame 120 and provides at least a partial Faraday cage for electrical components placed in the chamber 410. The chamber 410 allows placement of at least one electrical component 150 (for example, filter component) in close proximity to the set of connector pins 220 of the board-to-board connector 130. That is, the filtering components are placed directly beneath the board-to-board connector 130 and between the board-to-board connector 130 and the printed circuit board 110. As shown in FIG. 4, the chamber 410 is located underneath the board-to-board connector 130 and houses electrical components 150 (for example, filter components) between the board-to-board connector 130 and the printed circuit board 110. In addition, the electrical shielding 420 prevents electromagnetic and electrostatic influences on the filtering components or other electrical components 150 positioned in the chamber 410. As such, the electrical shielding 420 allows designers to place a component directly beneath another component while still meeting the electromagnetic compatibility and desense performance standards.

Figure 5:
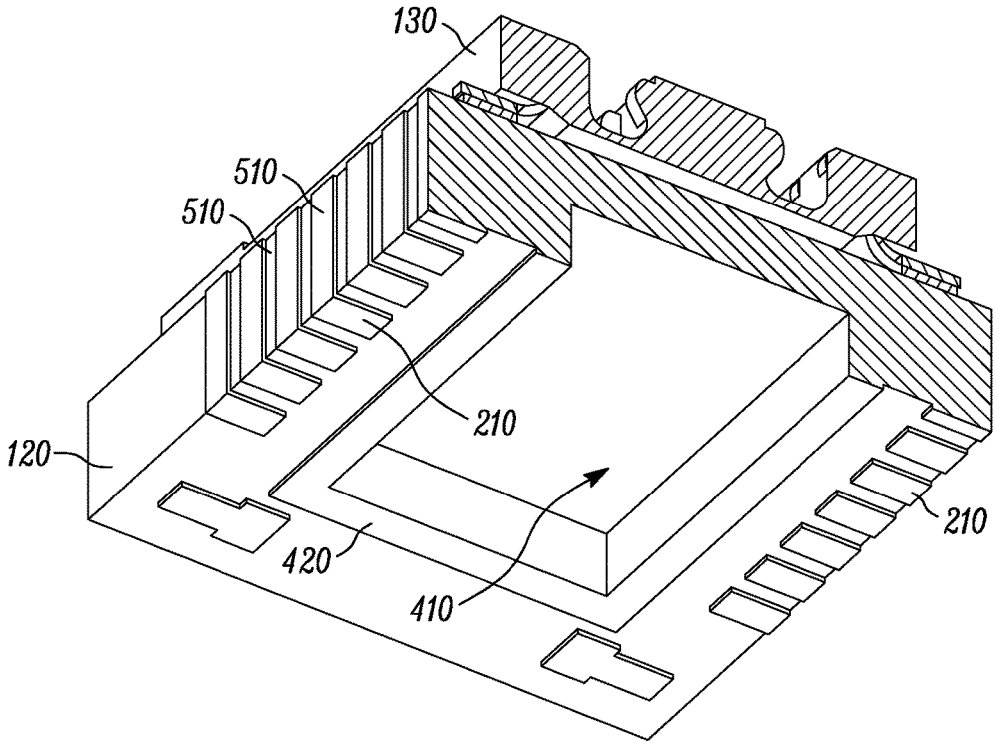
FIG. 5 is a cross section of an adapter frame in accordance with some embodiments.

FIG. 5 is a perspective view of the adapter frame 120. In the example illustrated, the second set of electrical pads 210 are integrally connected to the third set of electrical pads 310 (not shown). The second set of electrical pads 210 are connected to the third set of electrical pads 310 by running traces 510 (for example, one or more surface leads) over the sides of the adapter frame 120. In some embodiments, the traces 510 run through the adapter frame 120 via one or more through-holes 320 (shown in FIGS. 3 and 4) instead of on the sides of the adapter frame 120. FIGS. 2A through 5 illustrate only example embodiments of an adapter frame 120. In other embodiments, the adapter frame 120 may include more of fewer components and may perform functions that are not explicitly described herein.

Figure 6:
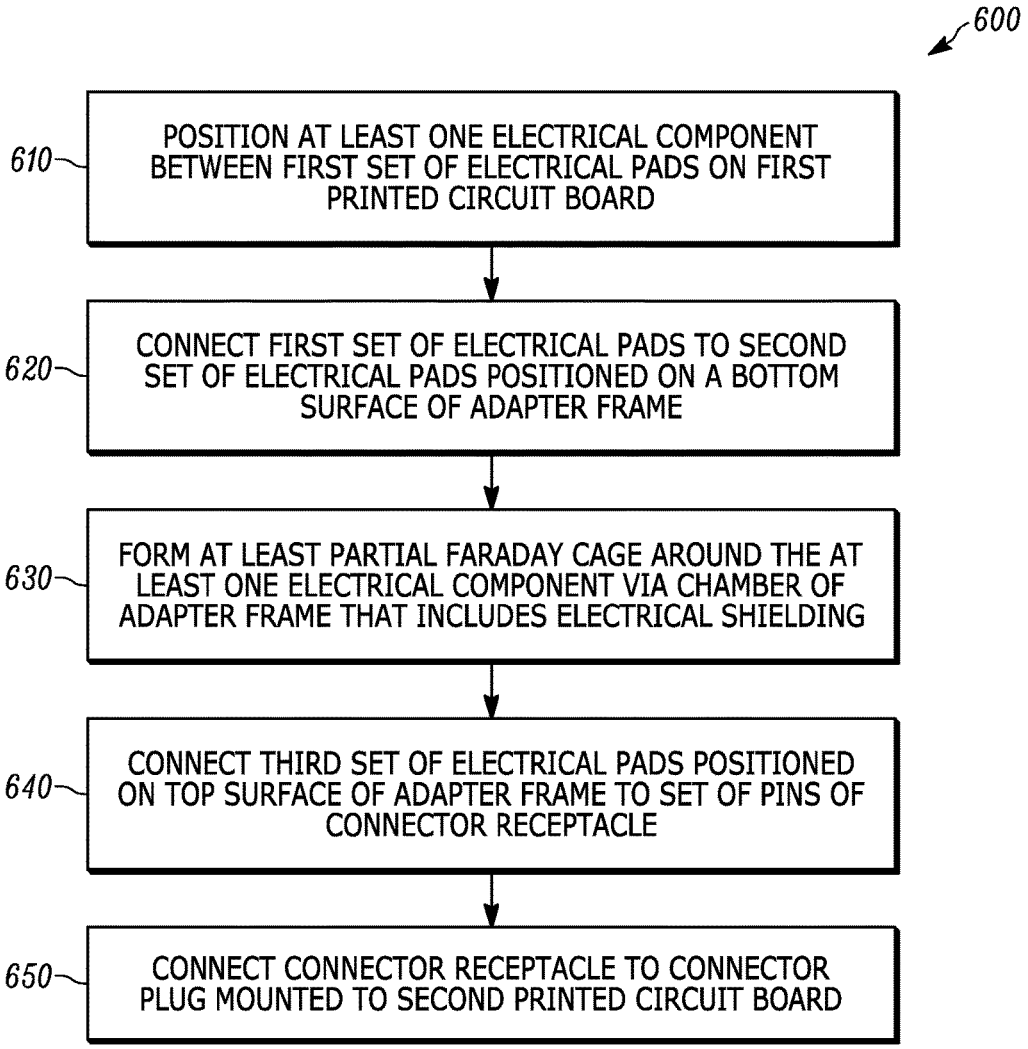
FIG. 6 is a flowchart of a method of connecting a first printed circuit board and a second printed circuit board in accordance with some embodiments.

FIG. 6 is a flowchart illustrating one example method 600 of connecting a first printed circuit board 110 and a second printed circuit board 170. As illustrated in FIG. 6, the method 600 includes positioning at least one electrical component 150 between the first set of electrical pads 160 on the first printed circuit board 110 (at block 610). The at least one electrical component 150 may be selected from the board components 140. In some embodiments, the at least one electrical component 150 is a filtering component. The method 600 also includes connecting the first set of electrical pads 160 to a second set of electrical pads 210 (shown in FIG. 2) positioned on the bottom surface of the adapter frame 120 (at block 620). In some embodiments, the second set of electrical pads 210 are soldered to the first set of electrical pads 160.

The adapter frame 120 forms at least a partial Faraday cage around the at least one electrical component 150 via the electrical shielding 420 of the chamber 410 of the adapter frame 120 (shown in FIG. 4) (at block 630). At block 640, the method 600 includes connecting the third set of electrical pads 310 positioned on the top surface of the adapter frame 120 (shown in FIG. 3) to the set of connector pins 220 of the connector receptacle of the board-to-board connector 130. In some embodiments, the third set of electrical pads 310 are soldered to the set of connector pins 220 of the connector receptacle 180.

The method 600 also includes connecting the connector receptacle 180 to a connector plug 190 mounted to a second printed circuit board 170 (at block 650). In some embodiments, the connector plug 190 includes a set of connector pins that are soldered to a set of electrical pads on the second printed circuit board 170.

In some embodiments, the first printed circuit board 110, the second printed circuit board 170, and the board-to-board connector 130 may be configured in accordance with requirements or configurations established by different manufacturers. As such, the first set of electrical pads 160 of the first printed circuit board 110 and the set of connector pins 220 of the board-to-board connector 130 may have different pitch. For example, the first set of electrical pads may have a first pitch whereas the set of connector pins 220 may have a second pitch. In these embodiments, the adapter frame 120 is designed such that the second set of electrical pads 210 have the first pitch 430 (shown in FIG. 4) and the third set of electrical pads 310 have the second pitch 330 (shown in FIG. 3). Thereby, the adapter frame 120 may be used to mount a board-to-board connector 130 to a printed circuit board 110 having a different pitch.

Figure 7:
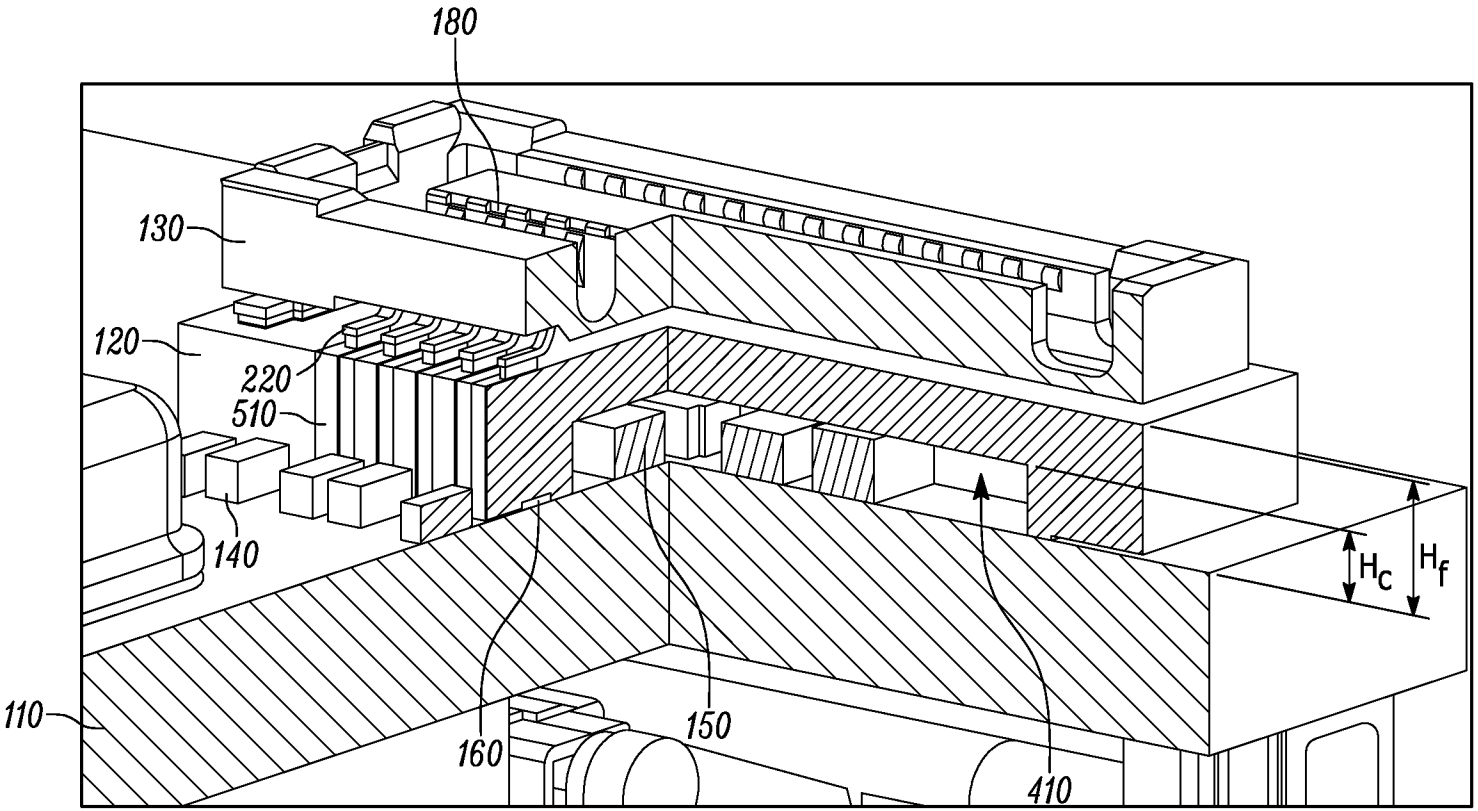
FIG. 7 is a cross section of a connector system in accordance with some embodiments.

FIG. 7 illustrates a cross-section of the connector system 100. In the example illustrated, an orientation of the components of the connector system 100 are shown. In the example provided, the electrical components 150 (for example, filter components) have a height of 0.3 millimeters to 0.5 millimeters. The chamber 410 including at least one of the electrical components 150 has a height, $H_c$, of 0.6 millimeters. The adapter frame 120 has a height, $H_f$, of 1 millimeter.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A connector system, comprising:

a printed circuit board having a first set of electrical pads and at least one electrical component positioned between the first set of electrical pads;

an adapter frame having a bottom surface, a top surface, a second set of electrical pads on the bottom surface and connected to the first set of electrical pads of the printed circuit board, a third set of electrical pads on the top surface and electrically connected to the second set of electrical pads, and a chamber configured to house the at least one electrical component and having electrical shielding that forms at least a partial Faraday cage around the at least one electrical component; and a connector receptacle having a set of pins connected to the third set of electrical pads.

2. The connector system of claim 1, wherein the second set of electrical pads has a first pitch and the third set of electrical pads has a second pitch.

3. The connector system of claim 1, wherein the second set of electrical pads and the third set of electrical pads are connected via one or more through-holes.

4. The connector system of claim 1, wherein the second set of electrical pads and the third set of electrical pads are connected via one or more surface leads.

5. The connector system of claim 1, wherein the at least one electrical component is at least one selected from a group consisting of: a filter component, a capacitor, an analog-to-digital converter, and a digital-to-analog converter.

6. The connector system of claim 1, wherein the connector receptacle is connected to a connector plug of a second printed circuit board.

7. The connector system of claim 1, wherein the adapter frame is made of a different material than the printed circuit board.

8. A portable communication device, comprising:

a printed circuit board having a first set of electrical pads and at least one electrical component positioned between the first set of electrical pads; and a communications module comprising:

an adapter frame having a bottom surface, a top surface, a second set of electrical pads on the bottom surface and connected to the first set of electrical pads of the printed circuit board, a third set of electrical pads on the top surface and electrically connected to the second set of electrical pads, and a chamber configured to house the at least one electrical component and having electrical shielding that forms at least a partial Faraday cage around the at least one electrical component; and a connector receptacle having a set of pins connected to the third set of electrical pads.

9. The portable communication device of claim 8, wherein the second set of electrical pads has a first pitch and the third set of electrical pads has a second pitch.

10. The portable communication device of claim 8, wherein the second set of electrical pads and the third set of electrical pads are connected via one or more through-holes.

11. The portable communication device of claim 8, wherein the second set of electrical pads and the third set of electrical pads are connected via one or more surface leads.

12. The portable communication device of claim 8, wherein the at least one electrical component is at least one filter component.

13. The portable communication device of claim 8, wherein the connector receptacle is connected to a connector plug of a second printed circuit board.

14. The portable communication device of claim 8, wherein the adapter frame is made of a different material than the printed circuit board.

* * * * *